US006047142A

United States Patent [19]

Donaldson

[11] Patent Number: 6,047,142

[45] Date of Patent: Apr. 4, 2000

[54] TONER AGE CALCULATION IN PRINT ENGINE DIAGNOSTIC

[75] Inventor: Patricia J. Donaldson, Pittsford, N.Y.

[73] Assignee: Xerox Corporation, Stamford, Conn.

[21] Appl. No.: 09/318,953

[22] Filed: May 26, 1999

[51] Int. Cl.[7] ..... G03G 15/08

[52] U.S. Cl. ..... 399/27; 399/30; 399/53

[58] Field of Search ..... 399/24, 27–30, 399/53, 257, 258, 259; 347/140, 112

[56] References Cited

U.S. PATENT DOCUMENTS

| | | | |
|---|---|---|---|
| 5,162,874 | 11/1992 | Butler | 356/446 |
| 5,166,729 | 11/1992 | Rathbun et al. | 355/208 |
| 5,386,276 | 1/1995 | Swales et al. | 355/246 |
| 5,410,388 | 4/1995 | Pacer et al. | 355/208 |
| 5,581,335 | 12/1996 | Borton et al. | 355/246 |
| 5,710,958 | 1/1998 | Raj | 399/49 |
| 5,777,656 | 7/1998 | Henderson | 347/251 |
| 5,822,646 | 10/1998 | Kinoshita et al. | 399/24 |
| 5,887,221 | 3/1999 | Grace | 399/49 |
| 5,930,553 | 7/1999 | Hirst et al. | 399/24 |
| 5,950,040 | 9/1999 | Mestha et al. | 399/46 |

FOREIGN PATENT DOCUMENTS 3-276176 12/1991 Japan .

*Primary Examiner*—Quana Grainger
*Attorney, Agent, or Firm*—Paul F. Daebeler

[57] ABSTRACT

The present invention generally relates to a digital imaging system. More specifically, the present invention provides an improved method and apparatus for calculating toner age using a toner concentration sensor and mass sensor to ensure image quality by anticipating or diagnosing problems in image quality, which may be caused by toner age. These problems include low developability, high background, and halo defects appearing on sheets of support material.

16 Claims, 4 Drawing Sheets

TONER AGE CALCULATION IN PRINT ENGINE DIAGNOSTIC

FIELD OF THE INVENTION

The present invention generally relates to a digital imaging system. More specifically, the present invention provides an improved method and apparatus for calculating toner age to ensure image quality by anticipating or diagnosing problems in image quality, which may be caused by toner age. These problems include low developability, high background, and halo defects appearing on sheets of support material.

BACKGROUND OF THE INVENTION

Modern electronic copiers, printers, facsimile machines, etc. are capable of producing complex and interesting page images. The pages may include text, graphics, and scanned or computer-generated images. The image of a page may be described as a collection of simple image components or primitives (characters, lines, bitmaps, colors, etc.). Complex pages can then be built by specifying a large number of the basic image primitives. This is done in software using a page description language such as PostScript. The job of the electronic printer's software is to receive and interpret each of the imaging primitives for the page. The drawing, or rasterization must be done on an internal, electronic model of the page. All image components must be collected and the final page image must be assembled before marking can begin. The electronic model of the page is often constructed in a data structure called an image buffer. The data contained is in the form of an array of color values called pixels. Each actual page and the pixel's value provides the color which should be used when marking. The pixels are organized to reflect the geometric relation of their corresponding spots. They are usually ordered to provide easy access in the raster pattern required for marking.

In the prior art, a copier, printer or other document-generating device typically employs an initial step of charging a photoconductive member to substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member, which is subsequently transferred to a copy sheet. The copy sheet having the toner image thereon is then advanced to a fusing station for permanently affixing the toner image to the copy sheet.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are half-tone images. Therefore, many methods have been developed to monitor the toner development process to detect present or prevent future image quality problems.

For example, it is known to monitor the developed mass per unit area (DMA) for a toner development process by using densitometers such as infrared densitometers (IRDs) to measure the mass of a toner process control patch formed on an imaging member. IRDs measure total developed mass (i.e., on the imaging member), which is a function of developablitiy and electrostatics.

Electrostatic voltages are measured using a sensor such as an ElectroStatic Voltmeter (ESV). Developability is the rate at which development (toner mass/area) takes place. The rate is usually a function of the toner concentration in the developer housing. Toner concentration (TC) is measured by directly measuring the percentage of toner in the developer housing (which, as is well known, contains toner and carrier particles).

As indicated above, the development process is typically monitored (and thereby controlled) by measuring the mass of a toner process control patch and by measuring toner concentration (TC) in the developer housing. However, the relationship between TC and developability is affected by other variables such as ambient temperature, humidity and the age of the toner. For example, a three-percent TC results in different developabilities depending on the variables listed above. Therefore, in order to ensure good developability, which is necessary to provide high quality images, toner age must be considered.

Consequently, there is a need to provide a method and apparatus for calculating or determining toner age to ensure image quality by anticipating or diagnosing problems in image quality, which may be caused by toner age. These problems include low developability, high background, and halo defects appearing on sheets of support material.

SUMMARY OF THE INVENTION

According to one embodiment of the present invention, measuring and controlling toner age in a developer housing includes the steps of providing a maximum toner age in a memory; reading toner concentration in the developer housing and storing toner concentration in the memory; reading pixel count from a pixel counter, which has the pixel count of a digital image; reading and storing DMA in the memory; determining toner age in the developer housing based upon the toner concentration, pixel count and DMA; and interrupting a print job when the toner age is greater than a maximum toner age. If the toner age is greater than a maximum toner age, a message can be displayed on a user interface indicating the toner should be purged. Then, the toner can be purged in the developer housing to reduce the toner age in the developer housing.

There is also a method for measuring and controlling toner age in a developer housing including the steps of providing a toner age range in a memory; reading toner concentration in the developer housing and storing toner concentration in the memory; reading pixel count from a pixel counter, which has the pixel count of a digital image; reading and storing DMA in the memory; determining toner age in the developer housing based upon the toner concentration, pixel count and DMA; and calculating a MAC patch area to write toner when the toner age is in the toner age range in order to reduce the toner age in the developer housing. Writing toner to an interprint zone with the MAC patch area in order to reduce the toner age in the developer housing is scheduled.

An apparatus for measuring and controlling toner age in a developer housing including a memory storing a maximum toner age; a pixel counter receiving a digital image and counting the pixels in the digital image to provide a pixel count; a toner concentration sensor sensing a toner concentration in the developer housing; a mass sensor sensing a DMA; and a control unit receiving the pixel count, the toner concentration and the DMA, and determining the toner age in the developer housing based upon the pixel count, the toner concentration and the DMA. When the toner age exceeds the maximum toner age, a user interface displays a message indicating that the toner in the developer housing should be purged. A memory also stores a toner age range, and the control unit initiates writing toner to a MAC patch area to reduce the toner age when the toner age is in the toner age range.

An apparatus for measuring and controlling toner age in a plurality of developer housings including a memory storing a maximum toner age; a pixel counter receiving a digital image and counting the pixels in the digital image to provide a pixel count; a toner concentration sensor in each developer housing sensing a toner concentration in each developer housing; a mass sensor sensing a DMA; and a control unit receiving the pixel count, each toner concentration and the DMA, and determining the toner age in each developer housing based upon the pixel count, the toner concentration and the DMA. A user interface displays a message indicating the toner in one or more of the developer housings should be purged. The memory stores a toner age range. The control unit initiates writing toner to a MAC patch area to reduce the toner age when the toner age in one of the developer housings is in the toner age range.

A digital imaging system for generating an image from image signals including a photoreceptor; at least one charging unit charging the photoreceptor; at least one exposure unit receiving the image signals and exposing the photoreceptor to place the image on the photoreceptor; at least one developer housing containing toner and developing the image on the photoreceptor; a transfer unit transferring the toner on the photoreceptor to a support material; a fusing unit fusing the toner to the support material; a cleaner cleaning the photoreceptor after the support material has passed through the transfer unit;

a memory storing a maximum toner age; a pixel counter receiving the image signals and counting the pixels to provide a pixel count; a toner concentration sensor in each developer housing sensing a toner concentration; a mass sensor sensing a DMA; and a control unit receiving the pixel count, toner concentration and the DMA, determining the toner age in each developer housing based upon the pixel count, the toner concentration and the DMA. A user interface displaying a message indicating the toner in one or more of the developer housings should be purged when the toner age is greater than the maximum toner. The memory stores a toner age range and the control unit initiates writing toner to a MAC patch area to reduce the toner age when the toner age in one of the developer housings is in the toner age range. The digital imaging system may include a scanner for scanning the image, generating the image signals and transmitting the image signals to the exposure unit. The digital imaging system can be coupled to a computer network and receives image signals from the computer network.

DETAILED DESCRIPTION OF THE PRESENT INVENTION

Figure 1:
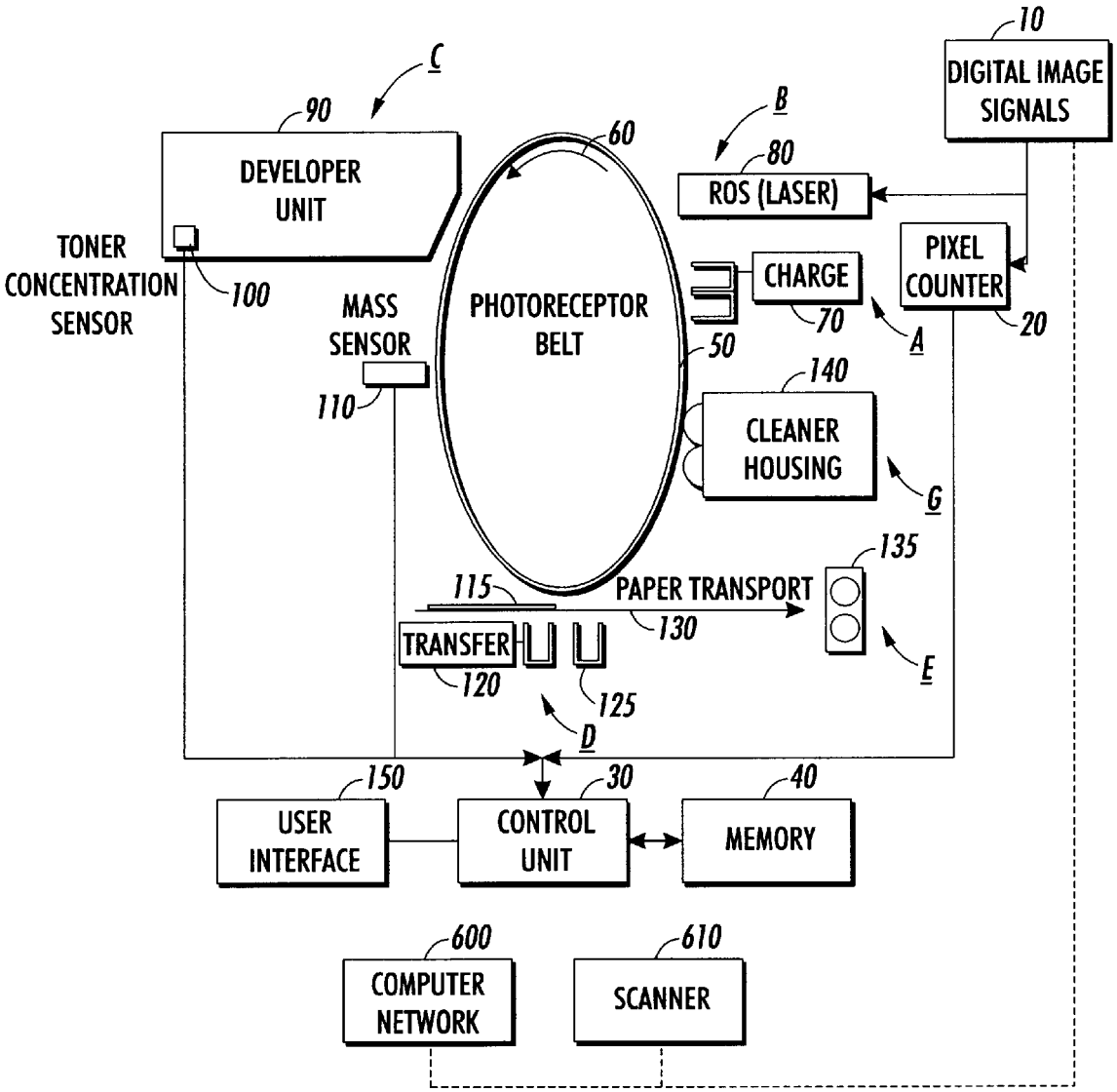
FIG. 1 is a partial schematic of an example of a print engine for a digital imaging system, which can employ the toner age calculation of the present invention.

FIG. 1 shows a partial schematic of an example of a print engine for a digital imaging system. Digital image signals 10 from a computer network 600, scanner 610, or other digital image signal generating device are received by a pixel counter 20, which counts the number of pixels in the digital image. The digital image signals 10 represent the desired output image to be imparted on at least one sheet. The pixel counter 20 outputs this information to a control unit 30, which stores this information in memory 40. The control unit 30 may be a microprocessor or other control device. The pixel counter 20 may be incorporated into the control unit 30.

A photoreceptor belt 50 advances sequentially through various xerographic process stations in the direction indicated by arrow 60. Other types of photoreceptors such as a photoreceptor drum may be substituted for the photoreceptor belt 50 for sequentially advancing through the xerographic process stations. A portion of the photoreceptor belt 50 passes through charging station A, where a charging unit 70 charges the photoconductive surface of photoreceptor belt 60 to a substantially uniform potential. Preferably, charging unit 70 is a corona-generating device such as a dicorotron.

Subsequently, the charged portion of photoreceptor belt 50 is advanced through imaging/exposure station B. The control unit 30 receives the digital image signals 10 from at least one digital image signal generating such as a scanning device (not shown). The control unit 30 processes and transmits these digital image signals 10 to an exposure device, which is preferably a raster output scanner 80 located at imaging/exposure station B. However, other xerographic exposure devices such as a plurality of light emitting diodes (an LED bar) could be used in place of the raster output scanner 80. The raster output scanner (ROS) 80 causes the charge retentive surface of the photoconductive belt 50 to be discharged at certain locations on the photoconductive belt 50 in accordance with the digital image signals 10 output from the digital image generating device. Thus, a latent image is formed on photoconductive belt 50.

Next, the photoconductive belt 50 advances the latent image to a development station C, where toner is electrostatically attracted to the latent image using commonly known techniques. The latent image attracts toner particles from the carrier granules in a developer unit 90 forming a toner powder image thereon. Alternatively, the developer unit 90 may utilize a hybrid development system, in which the development roll, better known as the donor roll, is powered by two development fields (potentials across the air gap). The first field is the ac field which is used for toner cloud generation. The second field is the dc development field which is used to control the amount of developed toner mass on the photoreceptor belt 50. Appropriate developer biasing is accomplished by way of a power supply. This type of system is a noncontact type in which only toner particles are attracted to a latent image and there is no mechanical contact between the photoreceptor belt 50 and the toner delivery device. However, the present invention can be utilized in a contact system as well. In accordance with the present invention, the developer unit 90 includes a toner concentration sensor 100, such as a packer toner concentration sensor, for sensing toner concentration (TC). A mass sensor 110, such as an enhanced toner area coverage (ETAC) sensor, measures developed mass per unit area.

Subsequent to image development, a sheet of support material 115 is moved into contact with toner images at transfer station D. The sheet of support material 115 is advanced to transfer station D by any known sheet feeding apparatus (not shown). The sheet of support material 115 is then brought into contact with the photoconductive surface of photoconductive belt 50 in a timed sequence so that the toner powder image developed thereon contacts the advancing sheet of support material 115 at transfer station D. Transfer station D preferably includes a transfer unit 120. Transfer unit 120 includes a coronagenerating device, which is preferably a dicorotron. The corona-generating device sprays ions onto the backside of sheet of support material 115. This attracts the oppositely charged toner particle images from the photoreceptor belt 50 onto the sheet of support material 115. A detack unit 125 (preferably a detack dicorotron) is provided for facilitating stripping of the sheet of support material 115 from the photoreceptor belt 50.

After transfer, the sheet of support material 115 continues to advance toward fuser station E on a conveyor belt (not shown) in the direction of arrow 130. Fuser station E includes a fuser unit 135, which includes fuser and pressure rollers to permanently affix the image to the sheet of support material 115. After fusing, a chute, not shown, guides the advancing sheets of support material 115 to a catch tray, stacker, finisher or other output device (not shown), for subsequent removal from the print engine by the operator.

After the sheet of support material 115 is separated from photoconductive surface of photoreceptor belt 50, the residual toner particles carried by the nonimage areas on the photoconductive surface are removed therefrom. These particles are removed at cleaning station G, using, for example, a cleaning brush or plural brush structure contained in a cleaner housing 140. However, the cleaning station G may utilize any number of well known cleaning systems.

Control unit 30 regulates the various print engine functions. The control unit 30 is preferably a programmable controller (such as a microprocessor), which controls the print engine functions hereinbefore described. The control unit 30 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Moreover, the control unit 30 reads or receives information from sensors such as toner concentration sensor 100 and mass sensor 110 for calculating toner age in order to predict or diagnose degradation in image quality. Based on this calculation, an appropriate action may be taken to restore image quality or prevent degradation in image quality before it occurs.

Figure 2:
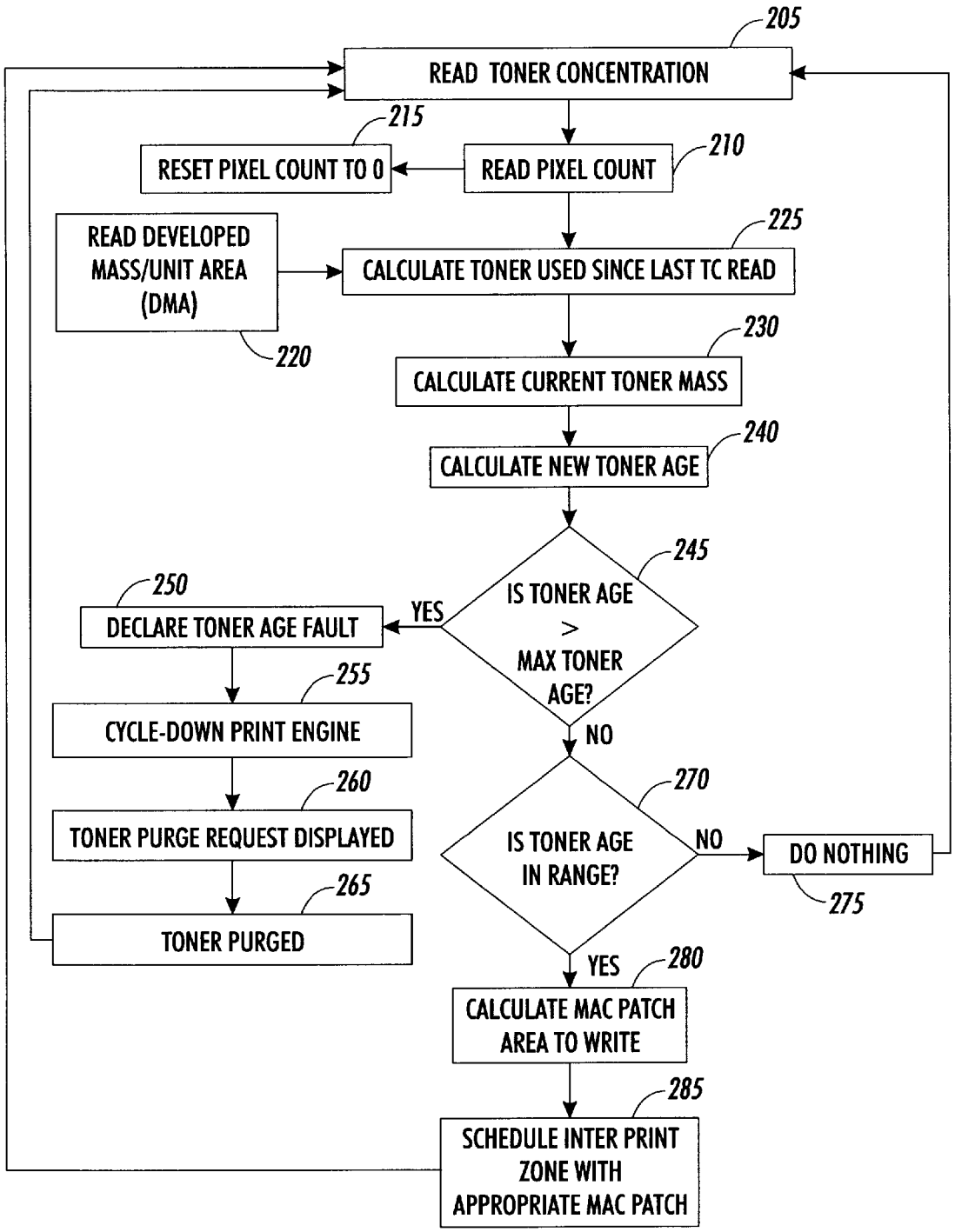
FIG. 2 is a flow chart showing the toner age calculation in accordance with the present invention.

FIG. 2 is a flow chart showing the process of the present invention, which calculates toner age and takes appropriate action based upon the results of the toner age calculation. Preferably, the control unit 30 reads the toner concentration (TC) every n seconds, wherein n is a positive number, and this number is stored in memory 40 (step 205). The control unit 30 reads the pixel count of the image from pixel counter 20 (step 210), and the pixel counter is reset to zero (step 215). In another embodiment, the control unit 30 also performs the pixel counting function. The control unit 30 reads the developed mass per unit area (DMA), sensed by mass sensor 110, and stores the DMA in memory 40 (step 220). The control unit 30 calculates the toner amount used since the last toner concentration was read (step 225) by using the DMA stored in memory 40.

The toner amount used since the last toner concentration was read is calculated using the following formula:

$$\text{Toner Used}=(\text{pixel count}*\text{developed mass per unit area})*(\text{unit area/pixels}) \quad \text{(Equation 1).}$$

For example, in a six hundred dots per inch (dpi) print engine, unit area per pixels would equal one inch squared divided by 600 pixels squared. Subsequently, the current toner mass in developer unit 90 is calculated by control unit 30 (step 230) by using the following formula:

$$\text{Current Toner Mass}=(\text{toner concentration}/100)*\text{carrier mass} \quad \text{(Equation 2)}$$

The carrier mass varies depending upon the print engine, and is generally determined by the manufacturer based on a number of factors including size of print engine, toner stability, speed of print engine, etc.

Then, the new toner age is calculated by the control unit 30 (step 240) using the following formula:

$$\text{New Toner Age}=[(\text{Current Toner Mass}-\text{Toner Used})*(\text{Previous Toner Age}+n\ \text{seconds}*\text{prints/second})]/\text{Current Toner Mass} \quad \text{(Equation 3)}$$

After the new toner age is calculated, the new toner age is compared to a predetermined maximum toner age, which is based on the appearance of image defects (step 245). An image is considered defective when the quality of the image does not meet predetermined customer, user or manufacturer print quality standards. If the current toner age is greater than the maximum toner age, then the control unit 30 recognizes a toner age fault and interrupts the current job (step 250). The print engine is cycled down (step 255), and a toner purge routine request is displayed at a user interface 150 (step 260). A toner purge routine may then be initiated by an operator of the print engine to purge the toner in the developer unit 90 to stop or prevent unacceptable print quality (step 265). The toner age continues to be recalculated during the toner purge routine, as in run-time, except that during the purge routine an out-of-range toner age does not trigger a fault or shut down the print engine. The toner purge routine decreases the toner age, for example, by running a high area coverage image. At the end of the toner purge routine, the operator may reinitiate the interrupted job.

If the new toner age is less than the predetermined maximum toner age, then the new toner age is compared to a predetermined toner age range (step 270). If the new toner age is less than a predetermined minimum toner age in the toner age range, the quality of the images is not affected by toner age (step 275). The toner age calculation process is repeated at the next scheduled toner concentration read by returning to step 205. The predetermined minimum toner age is based on a variety of factors including cost to customer, productivity and image quality.

If the new toner age falls within the toner age range, then a minimum area coverage (MAC) patch area is calculated based on the current toner age (step 280). The preferred MAC patch calculation minimizes toner usage and maximizes print engine productivity, while ensuring that toner age is maintained within the safe range, avoiding the necessity for toner purging and job interruption. The MAC patch area may be calculated automatically based on toner age in a number of different ways such as utilizing a look-up table. An interprint zone with appropriate MAC patch(es) is scheduled (step 285).

Figure 3:
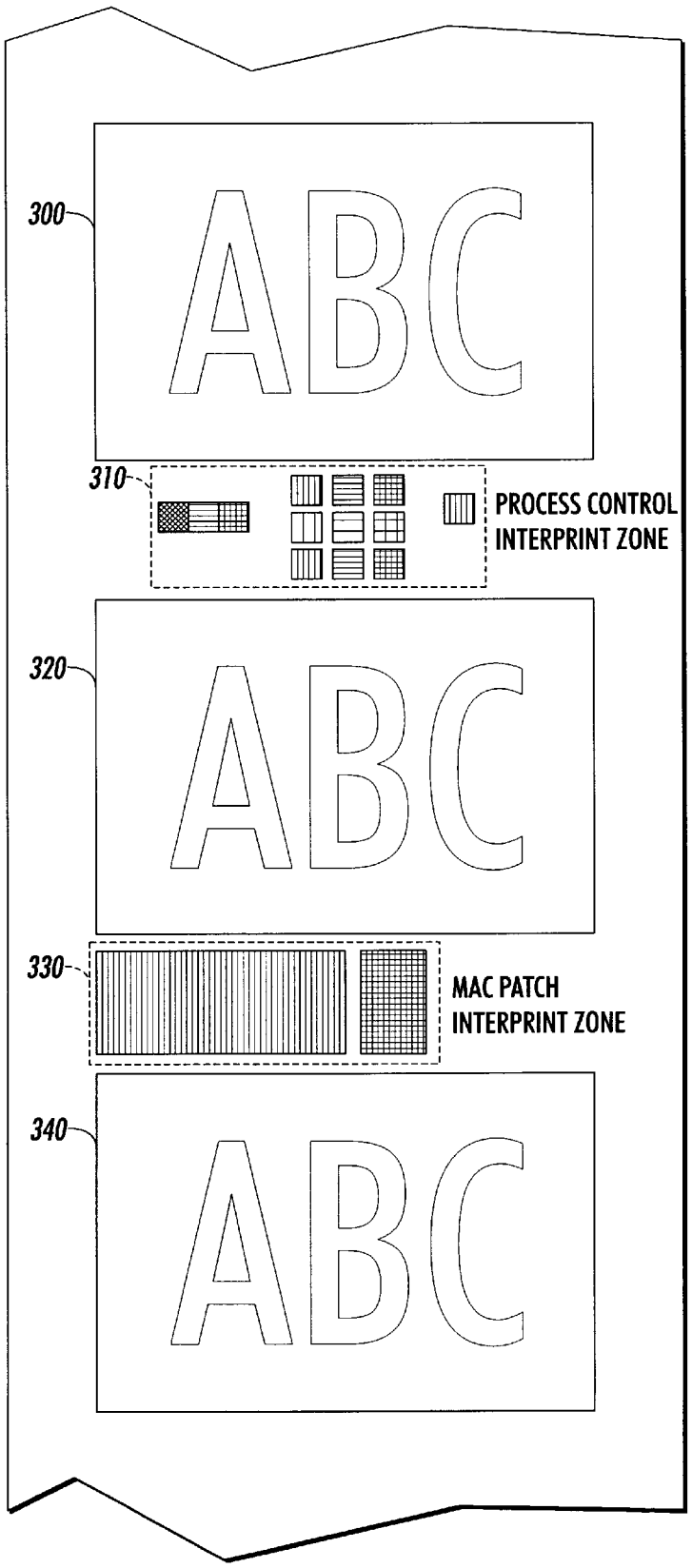
FIG. 3 is a layout showing one implementation of customer images, process control patches and MAC patches on a photoreceptor.

FIG. 3 shows one example of a layout of customer images, process control patches and MAC patches on a photoconductive surface (e.g. surface of photoreceptive belt 50) over time. A print zone on the surface dedicated to the customer image 300 is followed by an interprint zone 310 in which control patches are laid out to be read by electrostatic or development sensors.

Another customer image 320 is laid out, followed by an interprint zone 330 in which one or more MAC patches are laid out, for the purpose of maintaining toner age. In FIG. 3, the MAC patch interprint zone 330 contains patches for two different colors. The MAC patch interprint zone is followed by another customer image 340. It is understood that FIG. 3 is just one example of the many different types of layouts that can be utilized.

Figure 4:
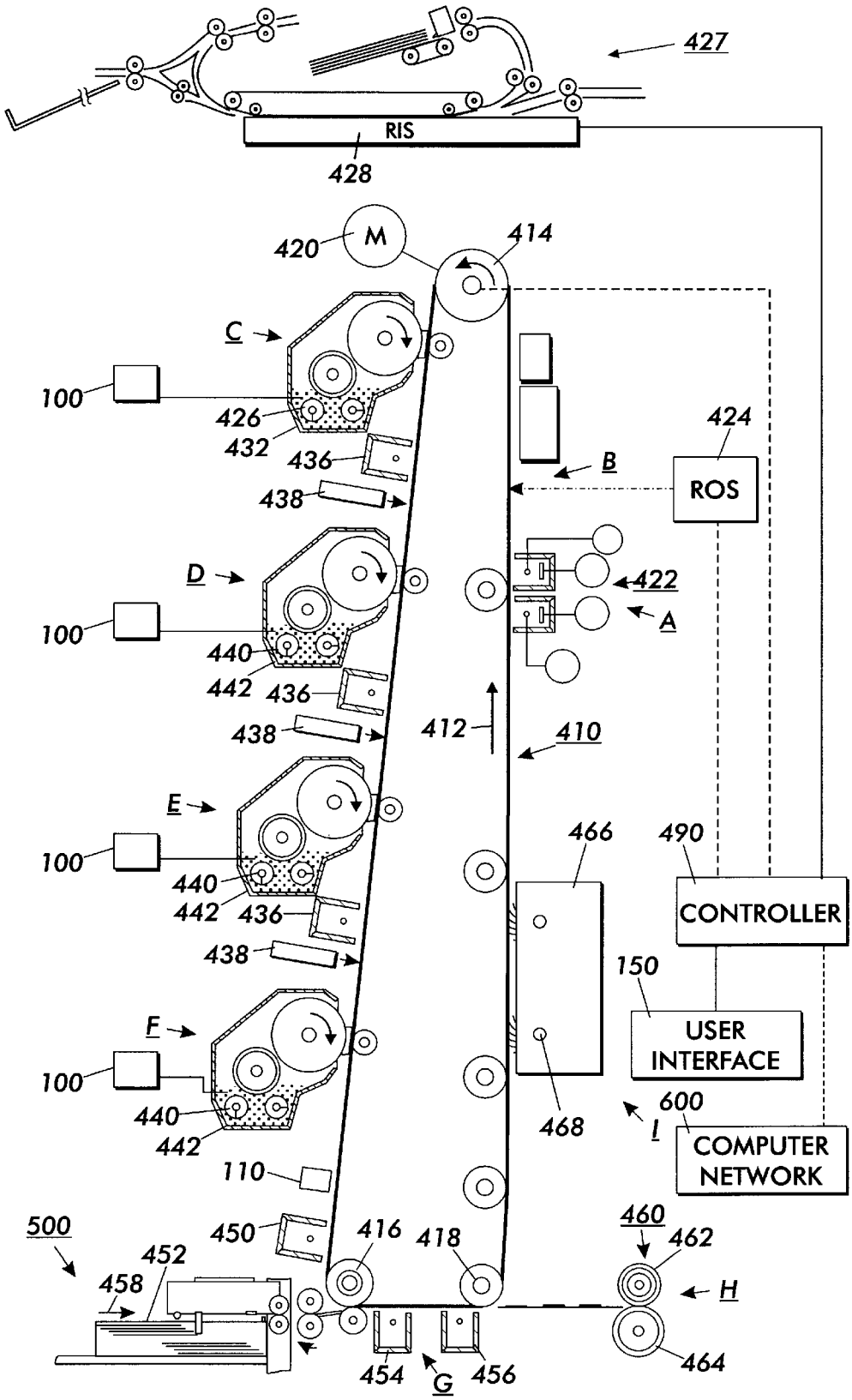
FIG. 4 is a partial schematic elevational view of another example of a digital imaging system, which can employ the toner age calculation of the present invention.

FIG. 4 is a partial schematic view of a digital imaging system, such as the digital imaging system of U.S. application Ser. No. 09/220,972, utilizing the toner age calculation process and apparatus of the present invention. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

In this embodiment, an original document can be positioned in a document handler 427 on a raster-input scanner (RIS) indicated generally by reference numeral 428. The RIS 428 captures the entire original document and converts it to a series of raster scan lines or image signals. This information is transmitted to an electronic subsystem (ESS) or controller 490 which controls a raster output scanner (ROS) 424. In this embodiment, controller 490 includes a pixel counter. Alternatively, image signals may be supplied by a computer network 600.

The printing machine preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension rollers 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from raster input scanner 428 representing the desired output image and processes these signals to convert them to the various color separations of the image which is transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage Vo, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or background areas.

At a first development station C, developer structure, indicated generally by the reference numeral 432 utilizing a hybrid development system, the development roll, better known as the donor roll, is powered by two development fields (potentials across an air gap). The first field is the ac field which is used for toner cloud generation. The second field is the dc development field which is used to control the amount of developed toner mass on the photoreceptor belt 410. The toner cloud causes charged toner particles 426 to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles 440. Further, a toner concentration sensor 100 senses the toner concentration in the developer structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 4, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheets 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the nonimage areas on the photoconductive surface are removed therefrom. These particles are removed at cleaning station I using a cleaning brush or plural brush structure contained in a housing 466. The cleaning brush 468 or brushes 468 are engaged after the composite toner image is transferred to a sheet. Once the photoreceptor belt 410 is cleaned the brushes 468 are retracted utilizing a device incorporating a clutch (not shown) so that the next imaging and development cycle can begin.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

The steps in the flow chart in FIG. 2 are repeated for each developer in FIG. 4 to measure the toner age. After the new toner age is calculated, the new toner age is compared to a predetermined maximum toner age, which is based on a variety of factors including cost to customer, productivity and image quality. (step 245).

If the current toner age is greater than the maximum toner age, then the control unit 30 recognizes a toner age fault and interrupts the current job (250).

The print engine is cycled down (step 255) and a toner purge routine request is displayed at a user interface 150 (step 260). When an operator initiates the toner purge routine, the toner age continues to be recalculated during the toner purge routine, as in run-time, except that during the purge routine an out-of-range toner age does not trigger a fault or shut down the print engine. The toner purge routine decreases the toner age, for example, by running a high area coverage image. At the end of the toner purge routine, the operator may reinitiate the interrupted job.

If the new toner age is less than the predetermined maximum toner age, then the new toner age is compared to a predetermined toner age range (step 270). If the new toner age is less than the predetermined minimum toner age in 25 the toner age range, the quality of the images is not affected by toner age (step 275). The toner age calculation process is repeated at the next scheduled toner concentration read by returning to step 205. The predetermined minimum toner age is based on a variety of factors including cost to customer, productivity and image quality.

If the new toner age falls within the toner age range, then a MAC patch area is calculated based on the current toner age (step 280). The preferred MAC patch calculation minimizes toner usage and maximizes print engine productivity, while ensuring that toner age is maintained within the safe range, avoiding the necessity for toner purging and job interruption. The MAC patch area may be calculated automatically based on toner age in a number of different ways such as utilizing a look-up table. An interprint zone with appropriate MAC patch(es) is scheduled (step 285).

While FIGS. 1 and 4 show two examples of a digital imaging system incorporating the toner age calculation of the present invention, it is understood that this process could be used in any digital document reading, generating or reproducing device.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

I claim:

1. A method for measuring and controlling toner age in a developer housing comprising the steps of:

providing a maximum toner age in a memory;

reading toner concentration in the developer housing and storing toner concentration in the memory;

reading pixel count from a pixel counter, which has the pixel count of a digital image;

reading and storing developed mass per unit area in the memory;

determining toner age in the developer housing based upon the toner concentration, pixel count and developed mass per unit area; and interrupting a print job when the toner age is greater than a maximum toner age.

2. The method of claim 2, further comprising the step of displaying on a user interface a message indicating the toner is being purged.

3. The method of claim 2, further comprising purging the toner in the developer housing to reduce the toner age in the developer housing.

4. A method for measuring and controlling toner age in a developer housing comprising the steps of:

providing a toner age range in a memory;

reading toner concentration in the developer housing and storing toner concentration in the memory;

reading pixel count from a pixel counter, which has the pixel count of a digital image;

reading and storing developed mass per unit area in the memory;

determining toner age in the developer housing based upon the toner concentration, pixel count and developed mass per unit area; and calculating a minimum area coverage patch area to write toner when the toner age is in the toner age range in order to reduce the toner age in the developer housing.

5. The method of claim 4, further comprising the step of scheduling an interprint zone with the minimum area coverage patch area in order to reduce the toner age in the developer housing.

6. An apparatus for measuring and controlling toner age in a developer housing comprising:

a memory storing a maximum toner age;

a pixel counter receiving a digital image and counting the pixels in the digital image to provide a pixel count;

a toner concentration sensor sensing a toner concentration in the developer housing;

a mass sensor sensing a developed mass per unit area; and a control unit receiving the pixel count, the toner concentration and the developed mass per unit area, determining the toner age in the developer housing based upon the pixel count, the toner concentration and the developed mass per unit area, and initiating a purging of the toner in the developer housing when the toner age is greater than the maximum toner age.

7. The apparatus of claim 6, further comprising a user interface displaying a message indicating the toner in the developer housing should be purged.

8. The apparatus of claim 6, wherein the memory stores a toner age range; and the control unit initiates writing toner to a minimum area coverage patch area to reduce the toner age when the toner age is in the toner age range.

9. An apparatus for measuring and controlling toner age in a plurality of developer housings comprising:

a memory storing a maximum toner age;

a pixel counter receiving a digital image and counting the pixels in the digital image to provide a pixel count;

a toner concentration sensor in each developer housing sensing a toner concentration in each developer housing;

a mass sensor sensing a developed mass per unit area; and a control unit receiving the pixel count, each toner concentration and the developed mass per unit area, and determining the toner age in each developer housing based upon the pixel count, the toner concentration and the developed mass per unit area.

10. The apparatus of claim 9, further comprising a user interface displaying a message indicating the toner in one or more of the developer housings should be purged when the toner age in any developer housing is greater than the maximum toner age.

11. The apparatus of claim 9, wherein the memory stores a toner age range; and the control unit initiates writing toner to a minimum area coverage patch area to reduce the toner age when the toner age in one of the developer housings is in the toner age range.

12. A digital imaging system for generating an image from image signals comprising:

a photoreceptor;

at least one charging unit charging the photoreceptor;

at least one exposure unit receiving the image signals and exposing the photoreceptor to place the image on the photoreceptor;

at least one developer housing containing toner and developing the image on the photoreceptor;

a transfer unit transferring the toner on the photoreceptor to a support material;

a fusing unit fusing the toner to the support material;

a cleaner cleaning the photoreceptor after the support material has passed through the transfer unit;

a memory storing a maximum toner age;

a pixel counter receiving the image signals and counting the pixels to provide a pixel count;

a toner concentration sensor in each developer housing sensing a toner concentration in each developer housing;

a mass sensor sensing a developed mass per unit area; and a control unit receiving the pixel count, each toner concentration and the developed mass per unit area, and determining the toner age in each developer housing based upon the pixel count, the toner concentration and the developed mass per unit area.

13. The digital imaging system as in claim 12, wherein the document-generating device includes a scanner for scanning the image, generating the image signals and transmitting the image signals to the exposure unit.

14. The digital imaging system as in claim 12, wherein the document-generating device is coupled to a computer network and receives image signals from the computer network.

15. The digital imaging system as in claim 12, further comprising a user interface displaying a message indicating the toner in one or more of the developer housings should be purged when the toner age in any developer housing is greater than the maximum toner age.

16. The digital imaging system as in claim 12, wherein the memory stores a toner age range; and the control unit initiates writing toner to a minimum area coverage patch area to reduce the toner age when the toner age in one of the developer housings is in the toner age range.

* * * * *